US005735561A

United States Patent [19]

Parkins

[11] Patent Number: 5,735,561

[45] Date of Patent: Apr. 7, 1998

[54] LIFT DEVICE FOR SMALL WATERCRAFT

[75] Inventor: David G. Parkins, Ft. Lauderdale, Fla.

[73] Assignee: ABL Boatlifts, Fort Myers, Fla.

[21] Appl. No.: 701,526

[22] Filed: Aug. 26, 1996

[51] Int. Cl.[6] ..... B63C 7/20; B66C 13/02

[52] U.S. Cl. ..... 294/74; 114/44; 294/66.1; 294/67.31; 405/3

[58] Field of Search ..... 294/4, 16, 28, 294/30, 31.1, 66.1, 67.1, 67.3, 67.31, 67.4, 74, 82.13, 82.27, 82.32, 85, 106, 111, 112, 164, 168; 114/44, 45; 405/1, 3

[56] References Cited

U.S. PATENT DOCUMENTS

| | | | |
|---|---|---|---|
| 396,881 | 1/1889 | Lander | 294/112 |
| 1,105,734 | 8/1914 | Wilcox | 294/28 X |
| 1,271,435 | 7/1918 | Cloutier | 294/66.1 X |
| 1,311,958 | 8/1919 | Finlay | 294/67.3 |
| 2,198,244 | 4/1940 | Chapman | 294/16 X |
| 2,358,218 | 9/1944 | Diamantides | 294/66.1 |
| 2,364,316 | 12/1944 | Royal et al. | 294/106 |
| 2,434,163 | 1/1948 | Jobe | 294/106 |
| 2,819,924 | 1/1958 | Hayes | 294/67.31 |
| 2,829,781 | 4/1958 | Nomsen . | |
| 3,383,721 | 5/1968 | Adams | 294/66.1 X |
| 4,826,228 | 5/1989 | Dinitz et al. | 294/81.56 |
| 4,973,094 | 11/1990 | Tana et al. | 114/44 X |
| 5,108,251 | 4/1992 | Lougheed et al. | 414/546 |
| 5,329,394 | 7/1994 | Urbank | 294/74 |

*Primary Examiner*—Johnny D. Cherry
*Attorney, Agent, or Firm*—Russell & Russell, L.L.P.

[57] ABSTRACT

A lift device for use in raising and lowering personal watercraft, often known as jet-skis, and small boats having a weight of up to about 2000 pounds. The lift device, which is portable and weighs less than about five pounds, has a pair of engaging members, shaped so as to securely engage the gunnels or upper edge of each side of a personal watercraft or small boat. Lifting members are connected to each end of the shaped engaging members forming a pair and are connected on the other end in an inverted V-shape to an attaching mechanism. The attaching mechanism allows the lift device to be removably attached to a raising or lowering device such as a winch. In its method of use, the attaching mechanism is attached to a raising or lowering device, the shaped engaging members are placed securely around the gunnels of each side of the personal watercraft or small boat, the raising or lowering device is activated, and the personal watercraft or small boat is raised out of or lowered into the water. These steps may be accomplished by one person, without requiring the person enter the water or to maneuver the watercraft.

24 Claims, 4 Drawing Sheets

LIFT DEVICE FOR SMALL WATERCRAFT

BACKGROUND

The invention relates generally to boat lifts and, more particularly, to a lift device apparatus and its method of use for lifting personal watercraft and small boats and having a weight of up to about 2000 pounds.

Attention is called to U.S. Pat. Nos: 2,829,781; 4,826,228; 5,108,251; and 5,320,394.

Personal watercraft, often known as "Jet-Skis", and small boats, are usually designed to be portable, are frequently transported to different land and water locations, and constantly need to be launched into and removed from the water. Even boats that are not transported to different locations are often taken out of the water when not in use. This can be accomplished by using a trailer to store and launch the boat or by using a stationary lift attached to a dock to raise and lower the boat, or by using a sling type flexible fabric harness to raise and lower the boat. However, many times a launch location suitable for a trailer is not convenient and a stationary lift may not be available or may be too expensive to install. In addition, since the boats are themselves portable, it is desirable that the lift device also be portable. Although sling type lifts made of fabric or other materials may be portable, they are limited in the weight of the boat that can be lifted, can easily slip and not securely engage the boat, may require maneuvering of the boat to position it within the sling, and require that the person operating the sling lift enter the water to position the sling lift around and under the boat. Besides being portable, it is desirable for the lift device to be easily stowed away when not in use. It is also desirable to be able to stow the lift device on board the small boat or personal watercraft, especially while the boat is in use, so that if the boat is to be taken to a location away from its initial launch location, the lift device is available and does not have to be separately transported. Since personal watercraft or small boats are often used by one person, in its method of operation, the lift device should be easy and safe to use by one person. Therefore, there is a need that the lift device be small in size when stowed and lightweight for both storage and operation. However, even though personal watercraft and small boats may be portable, they can also be quite heavy. So while the lift device must be lightweight for easy transportation and small enough to be easily stored in the limited space of a personal watercraft or small boat, the lift device must be capable of safely supporting the weight of a boat weighting hundreds, if not thousands of pounds. Therefore, the lift device must be able to securely engage the boat so as to be able to safely raise or lower it. In addition, since the weight, shapes and sizes of the boat to be raised or lowered differ greatly, the lift device needs to be capable of operating with many different sizes of boats, having different topside configurations and gunnels of varying sizes. Because the lift device is to be used in lake water or in salt water, the device must be resistant to corrosion. The lift device therefore must be able to lift the boat without gouging, marring or scratching the finished surface of the boat. In addition to these requirements for the lift device apparatus, the lift device itself must be easily and inexpensively fabricated and assembled.

For the foregoing reasons, there is a need, therefore for a lifting device that allows a personal watercraft or small boat to be easily lifted into and out of the water; that is itself portable and lightweight and small in size when stored away; strong enough to lift personal watercraft and small boats of up to about 2000 pounds; capable of operating with many sizes of boats with different topside configurations and different sized gunnels; easy and safe to use by one person; securely engages the small boat and personal watercraft while it is being prepared for raising or lowering and does not become detached from the personal watercraft or small boat due to movement of the craft; does not require extensive maneuvering or positioning of the personal watercraft or small boat to position it to be lifted by the lifting device; does not require the operator to enter the water to secure and use the lift device; is resistant to corrosion; does not gouge, mar or scratch the finished surface of the personal watercraft or small boat while the lifting device is being used; and is easily and inexpensively fabricated and assembled.

SUMMARY

The present invention is directed to a device, method of use and method of manufacture that satisfies these needs. The present invention provides for a lift device that allows a personal watercraft or small boat to be easily lifted into and out of the water; that is itself portable and lightweight and small in size when stored away; strong enough to lift personal watercraft and small boats of up to about 2000 pounds; capable of operating with many sizes of boats with different topside configurations and different sized gunnels; easy and safe to use by one person; securely engages the small boat and personal watercraft while it is being prepared for raising or lowering and does not become detached from the personal watercraft or small boat due to movement of the craft; does not require extensive maneuvering or positioning of the personal watercraft or small boat to position it to be lifted by the lifting device; does not require the operator to enter the water to secure and use the lift device; is resistant to corrosion; does not gouge, mar or scratch the finished surface of the personal watercraft while the lifting device is being used; and is easily and inexpensively fabricated and assembled.

A lift device having features of the present invention comprises an engaging member, shaped so as to securely engage the gunnels or upper edge of the side of a personal watercraft or small boat. The shaped engaging member comprises a shaped rod with a horizontal midsection and an upwardly curved end section on each end of the shaped rod. The shaped engaging member is connected on each end to a lifting member, which may be an elongated one piece cable or rod. The lifting members connected to each end of the shaped engaging members form a pair and are connected on the other end in an inverted V-shape to an attaching mechanism. A second engaging member, similarly attached to another pair of lifting members, is located opposite and faces the first engaging member, and its lifting members are also connected on one end in an inverted V-shape to the same attaching mechanism. The attaching mechanism allows the lift device to be removably attached to a raising or lowering device such as a winch.

In an alternate embodiment of the invention, each engaging member is connected to a pair of lifting members as described above. The lifting members are then connected on the other end in an inverted V shape to an attaching mechanism. A second engaging member, similarly attached to another pair of lifting members, is rotated 180 degrees and faces the first engaging member and its lifting members are also connected on one end in an inverted V-shape to a second attaching mechanism.

The lifting members may be a metal cable coated with a protective covering. The present mode utilizes a galvanized steel (zinc coated) cable of about 3/16 inch diameter which is then coated with a protective vinyl coating. The cable is then swaged into holes formed in the engaging member. The coating protects the zinc coated galvanized steel from eroding and therefore prevents the steel from rusting. The vinyl coating also protects the surface of the boat to be raised or lowered from being marred or scratched by the lifting member. The vinyl coating can be applied in any color as aesthetics dictate. The vinyl coating has the added benefit of having non-slip characteristics. Because in this embodiment, the cables are flexible, the lift device is capable of operating with many sizes of personal watercraft and small boats with different topside configurations.

The engaging member may be shaped from a solid metal rod, preferably aluminum. The rod is drilled on each end to form holes for the lifting members. The rod is then shaped to fit securely under the gunnel or upper edge of the side of a personal watercraft or small boat. The shape of the rod may be changed based on the size of the gunnel. The rod is then treated and coated with a protective material. In the current best mode, the rod is made of the aluminum alloy 6061-T6 and the protective material is vinyl which is applied onto the rod and heated to cure. The protective vinyl coating keeps the metal from corroding and in the aluminum version, the vinyl keeps the aluminum from oxidizing and changing in appearance. The vinyl coating can be applied in any color as aesthetics dictate. The protective vinyl coating also protects the surface of the boat to be raised or lowered from being gouged, marred and scratched by the engaging member. The vinyl coating has the added benefit of having non-slip characteristics and therefore can more safely secure the engaging member to the personal watercraft or small boat during raising or lowering.

The attaching mechanism may be a metal eye hook. In the present invention, an aluminum eye hook sufficient to support a weight of about 2000 pounds is used and is coated on the outside with a protective vinyl coating that protects the surface of the boat to be raised or lowered from being gouged, marred and scratched by the attaching mechanism. The vinyl coating can be applied in any color as aesthetics dictate. The vinyl coating has the added benefit of having non-slip characteristics.

In an alternate embodiment, the engaging member and the lifting members may be one piece. They may be shaped from a solid metal rod, preferably aluminum. The rod is drilled on each end to form holes for attaching to the attaching mechanism. The rod is then shaped to fit securely under the gunnels or upper edge of the side of a personal watercraft or small boat and to extend up to the attaching mechanism in an inverted V-shape. The rod is then treated and coated with a protective material. In the current best mode, the rod is made of the aluminum alloy 6061-T6 and the protective material is vinyl which is applied onto the rod and heated to cure. The protective vinyl coating keeps the metal from corroding and in the aluminum version, the vinyl keeps the aluminum from oxidizing and changing in appearance. The vinyl coating can be applied in any color as aesthetics dictate. The protective vinyl coating also protects the surface of the boat to be raised or lowered from being gouged, marred and scratched by the engaging member. The vinyl coating has the added benefit of having non-slip characteristics and therefore can more safely secure the one piece engaging and lifting member to the personal watercraft or small boat during raising or lowering.

In the present method, the attaching mechanism is attached to a raising or lowering device such as a winch or davit. The shaped engaging members are placed securely around the gunnels of each side of the personal watercraft or small boat. The raising or lowering device such as the winch or davit is activated and the personal watercraft or small boat is then raised out of or lowered into the water. The engaging members are then removed from each side of the personal watercraft or small boat. All these steps may be accomplished by one person, without requiring the person to enter the water.

DETAILED DESCRIPTION

Figure 1:
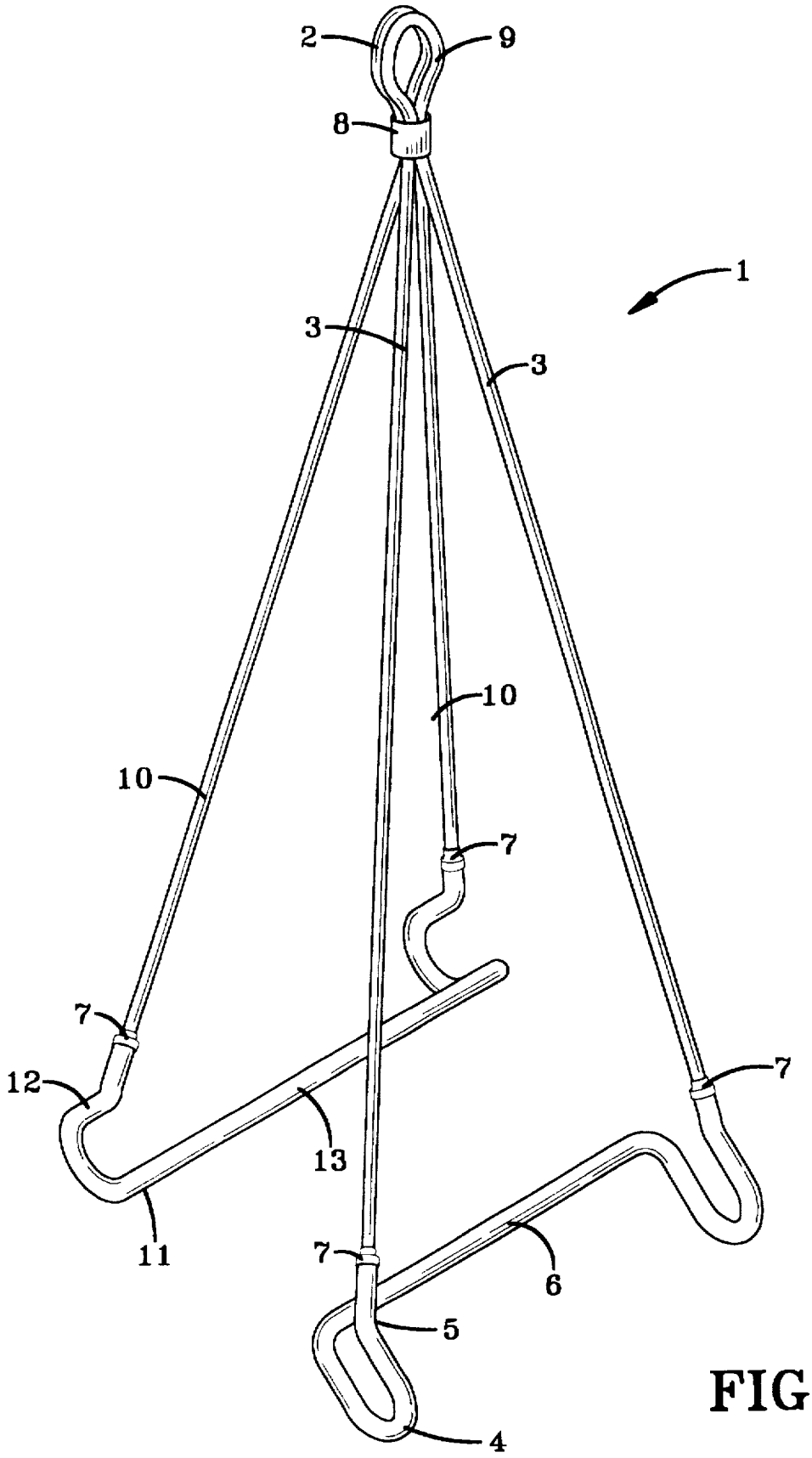
FIG. 1 shows a pictorial view of a preferred embodiment of the lift device for a personal watercraft or small boat.

Turning now to FIG. 1, a preferred embodiment of the lift device 1, is shown in accordance with the present inventive concepts. The lift device 1 comprises a plurality of lifting members 3 forming a pair, connected in a V-shape on one end to an attaching mechanism 2. The first pair of lifting members 3 are connected on the opposite end to the first shaped engaging member 4. The first shaped engaging member 4 comprises a horizontal midsection 6 with two upwardly curved ends 5. The connection of the shaped engaging member 4 on its two upwardly curved ends is covered by a covering cap 7. The connection of the pair of lifting members 3 and the attaching mechanism 2 is covered by a covering cap 8. The second side of the device is similarly comprised and is rotated 180 degrees so the first engaging member 6 and the second engaging member 11 face each other. A plurality of lifting members 10 form a pair, connected on one end in a V-shape to a second attaching mechanism 9. The second pair of lifting members 10 are connected on the opposite end to the second shaped engaging member 11. The second shaped engaging member 11 comprises a horizontal midsection 13 with two upwardly curved ends 12. The connection of the second shaped engaging member 11 on its two upwardly curved ends is covered by a covering cap 7. The connection of the second pair of lifting members 10 and the second attaching mechanism 9 is covered by a covering cap 8.

Figure 2:
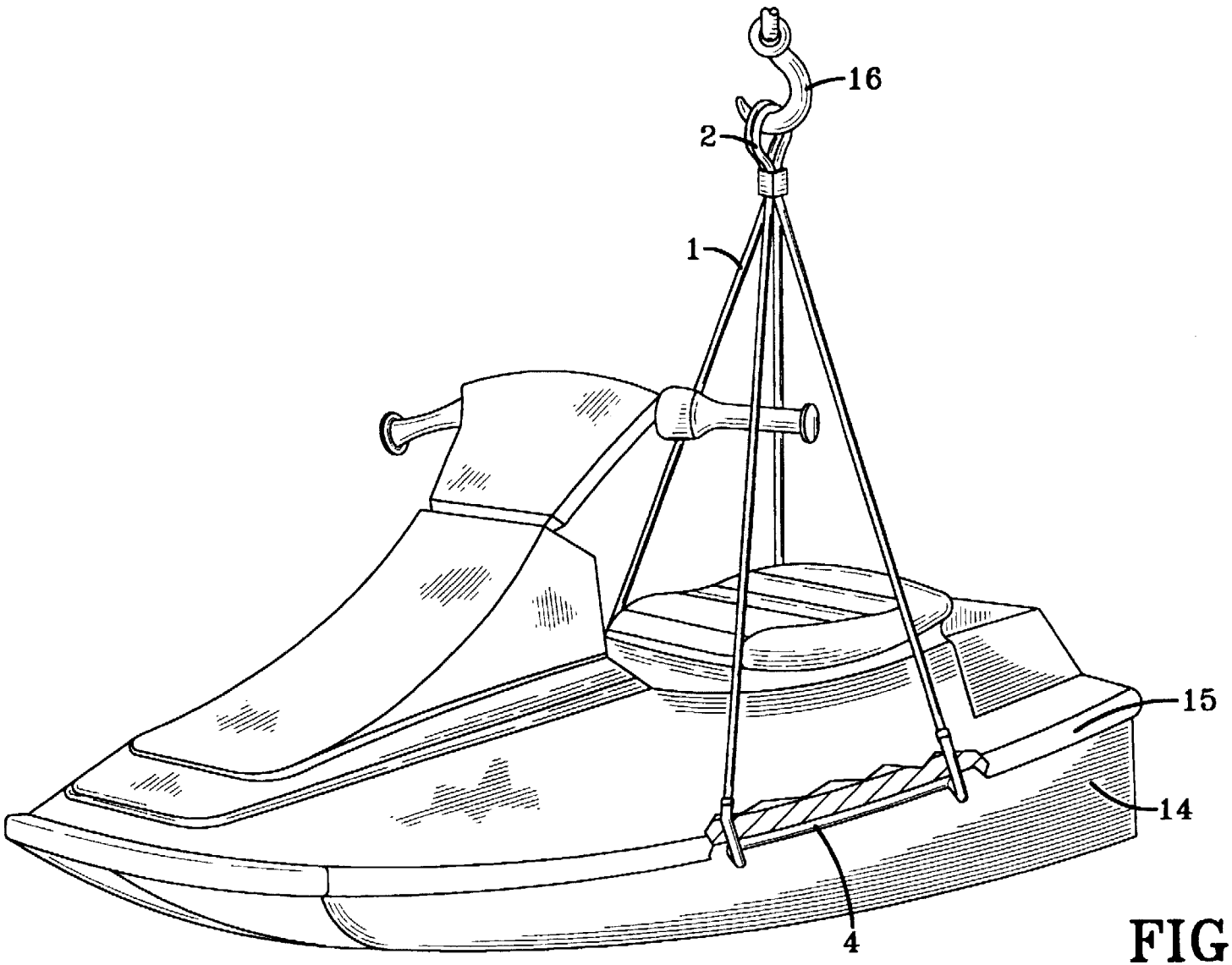
FIG. 2 shows a side view of a preferred embodiment of the lift device of FIG. 1 engaging a personal watercraft.

Turning now to FIG. 2, a preferred embodiment of the lift device 1, is shown in accordance with the present inventive concepts. The lift device 1 is shown engaging a personal watercraft 14. The shaped engaging member 4 is placed surrounding the gunnels 15 of the personal watercraft 14. The attaching mechanism 2 is attached to a hook 16 which may be connected to a winch or davit which is not shown.

Figure 3:
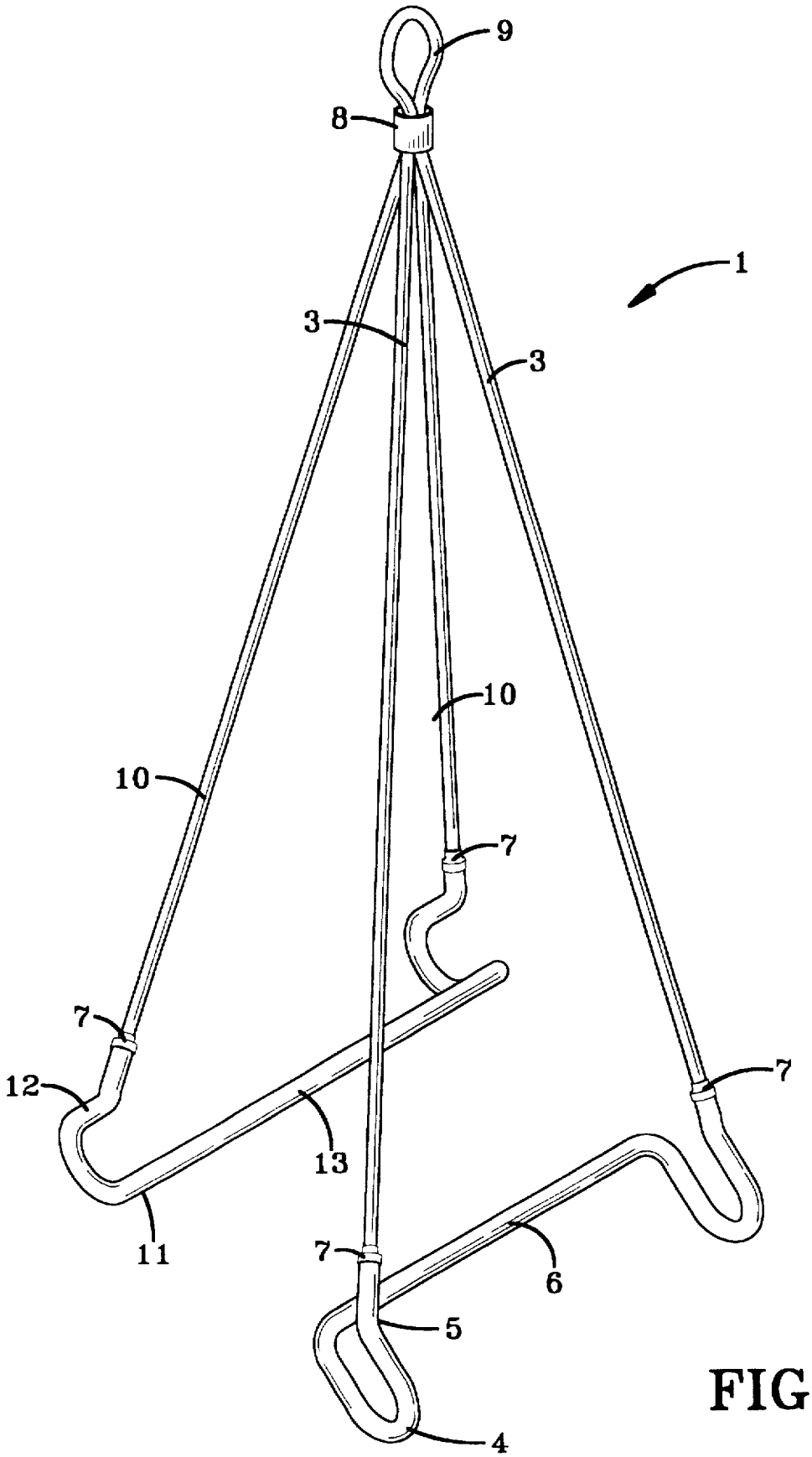
FIG. 3 shows a pictorial view of an alternative embodiment of the lift device for a personal watercraft or small boat.

Turning now to FIG. 3, an alternate embodiment of the lift device 1, is shown in accordance with the present inventive concepts. The lift device 1 comprises a plurality of lifting members 3 forming a pair, connected on one end in a V-shape to an attaching mechanism 9. The first pair of lifting members 3 are connected on the opposite end to the first shaped engaging member 4. The first shaped engaging member 4 comprises a horizontal midsection 6 with two upwardly curved ends 5. The connection of the shaped engaging member 4 on its two upwardly curved ends is covered by a covering cap 7. The second side of the device is similarly comprised and is located opposite so the first engaging member 6 and the second engaging member 11 face each other. A plurality of lifting members 10 form a pair, connected on one end in a V-shape to an attaching mechanism 9. The second pair of lifting members 10 are connected on the opposite end to the second shaped engaging member 11. The second shaped engaging member 11 comprises a horizontal midsection 13 with two upwardly curved ends 12. The connection of the second shaped engaging member 11 on its two upwardly curved ends is covered by a covering cap 7. The connection of the first pair of lifting members 3 and the second pair of lifting members 10 and the attaching mechanism 9 is covered by a covering cap 8.

Figure 4:
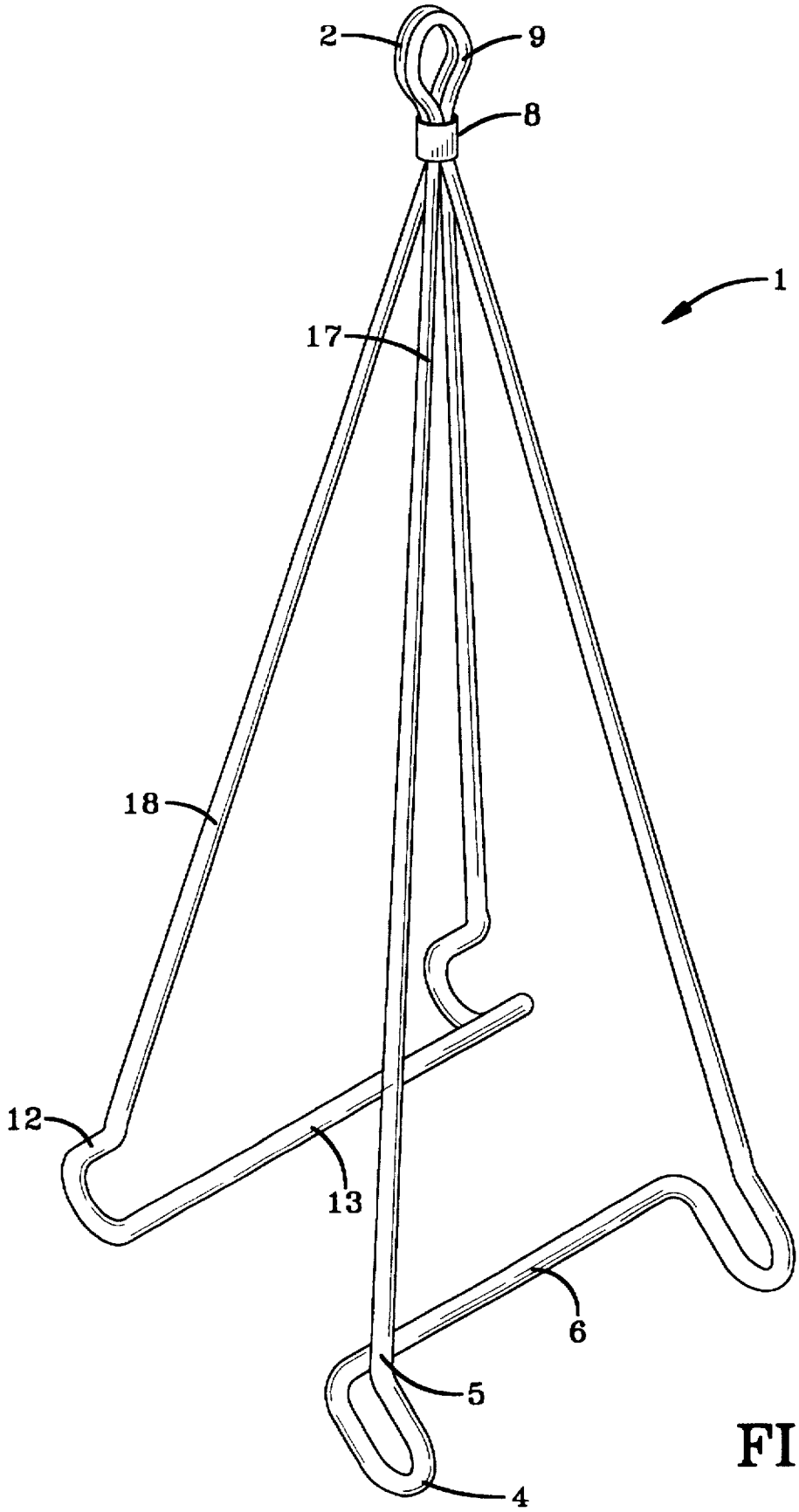
FIG. 4 shows a pictorial view of another alternative embodiment of the lift device for a personal watercraft or small boat.

Turning now to FIG. 4, an alternate embodiment of the lift device 1, is shown in accordance with the present inventive concepts. The lift device 1 comprises a first V-shaped one piece first engaging and lifting member 17 connected at the top of the V to an attaching mechanism 2. The first engaging and lifting member 17 comprises a horizontal midsection 6 with two upwardly curved ends 5 that extend upward in a V-shape to an attaching mechanism 2. The connection of the first engaging and lifting member 17 and the attaching mechanism 2 is covered by a covering cap 8. The second side of the device is similarly comprised and is located opposite so the first engaging and lifting member 17 and the second engaging and lifting member 18 face each other. The lift device I comprises a V-shaped one piece second engaging and lifting member 18 connected at the top of the V to an attaching mechanism 9. The second engaging and lifting member 18 comprises a horizontal midsection 13 with two upwardly curved ends 12 that extend upward in a V-shape to the attaching mechanism 9. The connection of the second engaging and lifting member 18 and the attaching mechanism 9 is covered by a covering cap 8.

Turning now to FIGS. 1 and 2, in the present method, the attaching mechanism 2 of the lift device 1 is attached to a hook 16 that is in turn attached to a raising or lowering device such as a winch or davit. The shaped engaging member 4 is placed securely around the gunnels 15 of each side of the personal watercraft or small boat 14. The second shaped engaging member 11 is placed on the opposite side of the personal watercraft or small boat (see FIG. 1 ). The raising or lowering device such as the winch or davit is activated and the personal watercraft or small boat 14 is then raised out of or lowered into the water. The engaging members 4 and 11 are then removed from each side of the personal watercraft or small boat. All these steps may be accomplished by one person, without requiring the person to enter the water and without requiring maneuvering of the personal watercraft or small boat.

Since the lift device is composed of a minimum number of pieces, it is easy to fabricate and assemble. Because the lift device weighs less than 5 pounds, it is easily transportable and is light enough to be carried aboard a personal watercraft or small boat. Even though the lift device is very lightweight, it can lift up to about 2000 pounds. Because the lift device is small in size, it can be easily stowed in a small space, either during transport or on board the personal watercraft or small boat. The shaped configuration of the engaging member allows the lift device to safely and securely engage the watercraft. The protective vinyl coating has non-slip characteristics as well and also helps to securely engage the personal watercraft or small boat. Because in one embodiment of the lift device the lifting members are semi-rigid galvanized cables, the lift device is able to lift boats with different topside configurations. In addition, because the materials are aluminum and galvanized steel coated with a protective coating, the lift device is corrosion resistant. The protective coating that exists on all parts of the lift device that might come in contact with the personal watercraft or boat, allows it to lift without gouging, marring or scratching the finished surface of the boat.

Although the present invention has been described in considerable detail with reference to certain preferred embodiments thereof, other embodiments are possible. Therefore, the spirit and scope of the appended claims should not be limited to the description of the preferred embodiments herein.

What is claimed is:

1. A lift device for a personal watercraft or a small boat, comprising:

a. a first and second shaped engaging member, each engaging member comprising a shaped rod with a horizontal midsection and an upwardly curved end section on each end of the rod shaped so as to securely engage a gunnel of a personal watercraft or small boat, the horizontal midsection of the first engaging member is positioned opposite from the horizontal midsection of the second engaging member whereby the shaped engaging members engage the gunnels of the personal watercraft or small boat;

b. an attaching mechanism for removably attaching the lift device to a raising or lowering device; and c. a plurality of elongated lifting members, each lifting member is connected on one end to one end section of one of the shaped engaging members and connected on the opposite end to the attaching mechanism.

2. A lift device for a personal watercraft or a small boat, according to claim 1, further comprising a second attaching mechanism wherein:

a. the lifting members, connected on one end to one end section of the first shaped engaging member, are connected on the opposite end to the first attaching mechanism; and b. the lifting members, connected on one end to one end section of the second shaped engaging member, are connected on the opposite end to the second attaching mechanism.

3. A lift device, according to claim 2, wherein the lifting members connected to the first shaped engaging member are one piece and the lifting members connected to the second shaped engaging member are one piece.

4. A lift device, according to claim 2, wherein the shaped rod of the engaging members is metal and coated with a protective coating so as not to scratch the personal watercraft and small boat.

5. A lift device, according to claim 4, wherein the shaped rod of the engaging members is aluminum and the protective coating is vinyl.

6. A lift device, according to claim 4, wherein the protective coating has non-slip characteristics.

7. A lift device, according to claim 2, wherein the weight of the lift device is less than about five pounds.

8. A lift device, according to claim 2, wherein the lift device can lift a personal watercraft or small boat having a weight of up to about 2000 pounds.

9. A lift device, according to claim 2, wherein the lifting members are galvanized steel cables with a diameter up to about ¼ inches coated with a protective vinyl coating.

10. A lift device, according to claim 9, wherein the galvanized steel cable lifting members are flexible cables enabling the lift device to raise and lower personal watercraft or small boats with varying topside configurations.

11. A lift device, according to claim 2, wherein the attaching mechanisms are metal eye hooks coated with a protective coating to prevent scratching of the personal watercraft and small boat to be engaged and lifted.

12. A lift device, according to claim 1, wherein the attaching mechanism is a metal eye hook coated with a protective coating to prevent scratching of the personal water-craft and small boat.

13. A lift device, according to claim 1, wherein the shaped rod of the engaging members is metal and is coated with a protective coating so as not to scratch the personal water-craft or small boat to be engaged and lifted.

14. A lift device, according to claim 13, wherein the shaped rod of the engaging members is aluminum and the protective coating is vinyl.

15. A lift device, according to claim 13, wherein the protective coating has non-slip characteristics.

16. A lift device, according to claim 1, wherein the weight of the lift device is less than 5 pounds.

17. A lift device, according to claim 1, wherein the lift device can lift a personal watercraft or small boat having a weight of up to about 2000 pounds.

18. A lift device, according to claim 1, wherein the lifting members are galvanized steel cables with a diameter up to about ¼ inches coated with a protective vinyl coating.

19. A lift device, according to claim 18, wherein the galvanized steel cable lifting members are flexible cables whereby the lift device can raise and lower personal water-craft and small boats with varying topside configurations.

20. A lift device, according to claim 1, wherein the elongated lifting member is a cable.

21. A lift device, according to claim 1, wherein the elongated lifting member is a rod.

22. A lift device according to claim 1, wherein the size and the shape of the shaped rod comprising the first and second shaped engaging member is based on the size of the gunnel that it is shaped to securely engage.

23. A kit for a lift device for a personal watercraft or a small boat, comprising:

a. a first and second shaped engaging member, each engaging member comprising a shaped rod with a horizontal midsection and an upwardly curved end section on each end of the rod shaped so as to securely engage a gunnel of a personal watercraft or small boat, the horizontal midsection of the first engaging member is positioned opposite from the horizontal midsection of the second engaging member whereby the shaped engaging members engage the gunnels of the personal watercraft or small boat;

b. an attaching mechanism for removably attaching the lift device to a raising or lowering device; and c. a plurality of elongated lifting members, each lifting member is connected on one end to one end section of one of the shaped engaging members and connected on the opposite end to the attaching mechanism.

24. A kit for a lift device for a personal watercraft or a small boat, according to claim 23, further comprising a second attaching mechanism, wherein:

a. the lifting members, connected on one end to one end section of the first shaped engaging member, are connected on the opposite end to the first attaching mechanism; and b. the lifting members, connected on one end to one end section of the second shaped engaging member, are connected on the opposite end to the second attaching mechanism.

* * * * *